US010966902B2

(12) United States Patent
Brader

(10) Patent No.: US 10,966,902 B2
(45) Date of Patent: Apr. 6, 2021

(54) LUNG GAS EXCHANGE DEVICE

(71) Applicant: Eric William Brader, Sewickley, PA (US)

(72) Inventor: Eric William Brader, Sewickley, PA (US)

( * ) Notice: Subject to any disclaimer, the term of this patent is extended or adjusted under 35 U.S.C. 154(b) by 702 days.

(21) Appl. No.: 15/072,695

(22) Filed: Mar. 17, 2016

(65) Prior Publication Data

US 2016/0271010 A1 Sep. 22, 2016

Related U.S. Application Data

(60) Provisional application No. 62/134,385, filed on Mar. 17, 2015.

(51) Int. Cl.
*A61H 23/02* (2006.01)

(52) U.S. Cl.
CPC ... *A61H 23/0263* (2013.01); *A61H 2201/165* (2013.01); *A61H 2201/1609* (2013.01); *A61H 2201/1671* (2013.01); *A61H 2201/5005* (2013.01); *A61H 2201/5089* (2013.01); *A61H 2205/04* (2013.01); *A61H 2230/405* (2013.01)

(58) Field of Classification Search
CPC ..... A61H 23/0254; A61H 23/0263; A61H 23/0281; A61H 23/029; A61H 2201/1609; A61H 2205/04; A61H 23/00; A61H 23/02; A61H 23/0218; A61H 23/0236; A61H 23/0245; A61H 2023/0209; A61H 2023/0227; A61H 2023/0272; A61H 2023/0281; A61H 2023/029; A61H 2230/06; A61H 2230/065; A61H 2230/207; A61H 2230/208; A61H 2230/205; A61H 2230/206
See application file for complete search history.

(56) References Cited

U.S. PATENT DOCUMENTS 4,052,981 A * 10/1977 Bachmann ..... A61H 23/0263 601/71
6,254,560 B1 * 7/2001 Tweardy ..... A61F 5/055 128/DIG. 23
6,267,741 B1 * 7/2001 Lerman ..... A61F 5/055 128/DIG. 23

(Continued)

OTHER PUBLICATIONS

A Hristara-Papadopoulou et al., "Current devices of respiratory physiotherapy", Oct.-Dec. 2008, http://www.ncbi.nlm.nih.gov/pmc/articles/PMC2580042/.

(Continued)

*Primary Examiner* — Justine R Yu
*Assistant Examiner* — Matthew R Moon
(74) *Attorney, Agent, or Firm* — Gerard M. Donovan; Sidharth Kapoor; Reed Smith LLP

(57) ABSTRACT

A lung gas exchange device includes a front housing, at least one strap configured to affix the front housing to an anterior neck of a user, a vibration device positioned within the front housing, a wear plate configured to transfer vibration from the vibration device to the anterior neck of the user, a power source configured to provide power to the vibration device, a power control mechanism configured to allow a user to turn on and off the vibration device; and a central processing unit board connected to the power control mechanism, the power source, and the vibration device.

19 Claims, 5 Drawing Sheets

(56) References Cited

U.S. PATENT DOCUMENTS 9,943,461 B1* 4/2018 Muench ..... A61H 31/006
2005/0059909 A1* 3/2005 Burgess ..... A61F 7/007 601/15
2005/0261612 A1* 11/2005 Hazan ..... A61H 23/0245 601/46
2006/0292538 A1* 12/2006 Kavana ..... G09B 5/04 434/307 A
2009/0118652 A1* 5/2009 Carlucci ..... A61H 7/007 601/134
2009/0143706 A1* 6/2009 Acosta ..... A61H 23/0263 601/46
2009/0176635 A1* 7/2009 Brinson ..... A61H 7/001 482/141
2011/0046432 A1* 2/2011 Simon ..... A61H 23/00 600/14
2012/0220905 A1* 8/2012 Avni ..... A61H 9/0078 601/2
2012/0253236 A1* 10/2012 Snow ..... A61N 5/0618 601/2
2012/0266873 A1* 10/2012 Lalonde ..... A61M 16/0057 128/201.13
2013/0158448 A1* 6/2013 Juto ..... A61H 9/0078 601/46
2013/0197409 A1* 8/2013 Baxter ..... A61H 23/00 601/46
2015/0157532 A1* 6/2015 Smith ..... A61H 23/0263 601/46
2017/0119620 A1* 5/2017 Trapp ..... A61H 23/00
2017/0196761 A1* 7/2017 Hyde ..... A61H 9/0057
2017/0273862 A1* 9/2017 Ludlow ..... A61H 23/00

OTHER PUBLICATIONS

Anthony J Guarascio et al., "The clinical and economic burden of chronic obstructive pulmonary disease in the USA", ClinicoEconomics and Outcomes Research, Jun. 14, 2013, http://www.ncbi.nlm.nih.gov/pmc/articles/PMC3694800/.

* cited by examiner

LUNG GAS EXCHANGE DEVICE

PRIORITY CLAIM

This application claims the benefit of U.S. Provisional Application No. 62/134,385, filed Mar. 17, 2015, the disclosure of which is incorporated by reference in its entirety.

BACKGROUND

Chronic respiratory diseases, such as Chronic Obstructive Pulmonary Disease (COPD), affect at least twelve million people in the United States. Chronic respiratory diseases are characterized by obstruction to airflow that interferes with normal breathing. Patients with severe chronic respiratory disease are disabled by the inability of their diseased lungs to efficiently perform gas exchange. Of those affected, over half report that symptoms impair their ability to perform activities of daily living.

COPD is a disease state where gas exchange, including both oxygen absorption and carbon-dioxide elimination, is reduced. COPD typically worsens over time, further reducing the ability of a patient's lungs to exchange gas. As a patient's disease worsens, it limits their ability to function in daily life. Once a patient's lung function drops below 30%, his or her quality of life can significantly decline, making it difficult to even walk down the street or carry things without running out of breath. Eventually, a patient will be unable to even get up and move around. At around 15% lung function, patients have extreme increased work in breathing and the disease quickly becomes non-survivable.

COPD is the third most common cause of death in the United States and the cause of a substantial economic burden on individuals and society. As explained in "The Clinical and Economic Burden of Chronic Obstructive Pulmonary Disease in the USA," by Anthony J Guarascio, Shaunta M. Ray, Christopher K. Finch, and Timothy H. Self (published online Jun. 17, 2013), the cost of COPD in the USA was projected to be approximately $50 billion in 2010, which included $20 billion in indirect costs and $30 billion in direct health care expenditures.

It is believed that in patients with COPD, carbon dioxide aggregates form in poorly stirred alveoli. These aggregates are believed to form from weak dipole-dipole interactions between carbon dioxide molecules. Such aggregates, particularly if left undisturbed by mechanical forces, could form progressively deepening confluent layers resting on the inner surface of the alveolus, increasingly widening the diffusion barrier. Vibration of the alveoli and the gas being exchanged is known to improve gas exchange in the lung. Known devices for improving gas exchange by vibration, however, are inconvenient to use, expensive, and do not effectively vibrate both the alveoli and the gas being exchanged.

For example, a high-frequency chest wall oscillation device, such as a ThAIRaphy Vest, has been used to oscillate the chest to help gas exchange. The device is a pneumatic vest that can be placed around a patient's chest to rapidly oscillate pressure to help vibrate the alveoli to increase gas exchange. But while the pneumatic vest vibrates the alveoli, it does not significantly vibrate the gas being exchanged. Further, the tissue surrounding the chest, such as muscle and fat, dampens the oscillation, thus limiting the amount that the oscillation results in vibration of the alveoli. In addition to being uncomfortable, the pneumatic vest requires an air compressor to pneumatically drive the vest and is thus inconvenient for patients due to its lack of portability.

Because of the requirement of an air compressor to drive the vest, they are typically used in hospital or clinical settings.

As an alternative, oral high-frequency oscillation devices have been developed to oscillate the air column and thus the air within the lungs. To give patients the benefit of the oscillating air column, such devices typically also require a ventilator attached to a mask that fits over the patient's face or a tube inserted in a patients throat to provide a sealed air system. Such devices are thus uncomfortable for patients and inconvenient because a patient cannot eat, drink, or effectively talk while using the ventilator. Additionally, such devices are inconvenient because they require a compressed air source and a motor to produce oscillations that can be superimposed on top of a patient's normal breathing. Further, the effectiveness of such devices is limited because they only vibrate the gas being exchanged and do not directly vibrate the alveoli.

Known respiratory assisting devices have low portability and are invasive, uncomfortable, and expensive. Additionally, no known respiratory assisting device effectively vibrates both the alveoli and the gas being exchanged. There is a need for an improved device that facilitates lung gas exchange.

Embodiments of a lung gas exchange device are described herein by way of example. Those skilled in the art recognize that lung gas exchange devices according to the present invention are not limited to the embodiments or drawings described herein. It should be understood that the drawings and description are not intended to be limited to the particular form disclosed. Rather, the intention is to cover all modifications, equivalents and alternatives falling within the spirit and scope of the disclosed embodiments. Any headings used herein are for organizational purposes only and are not meant to limit the scope of the description or the claims. As used herein, the word "may" is used in a permissive sense (i.e., meaning having the potential to) rather than the mandatory sense (i.e., meaning must). Similarly, the words "include," "including," and "includes" mean including, but not limited to.

DETAILED DESCRIPTION

Embodiments of the present invention provide a device that vibrates a user's, such as a patient's, trachea, thus effectively vibrating both the alveoli and the gas being exchanged to improve lung function. Embodiments include a portable device that may be conveniently and non-invasively affixed to a patient's neck, thus allowing a patient to walk, talk, eat, drink, and perform other routine tasks while having improved lung function. By improving gas exchange with a portable external device, patients with severe respiratory disease will become more active and thereby improve their health.

Figure 10:
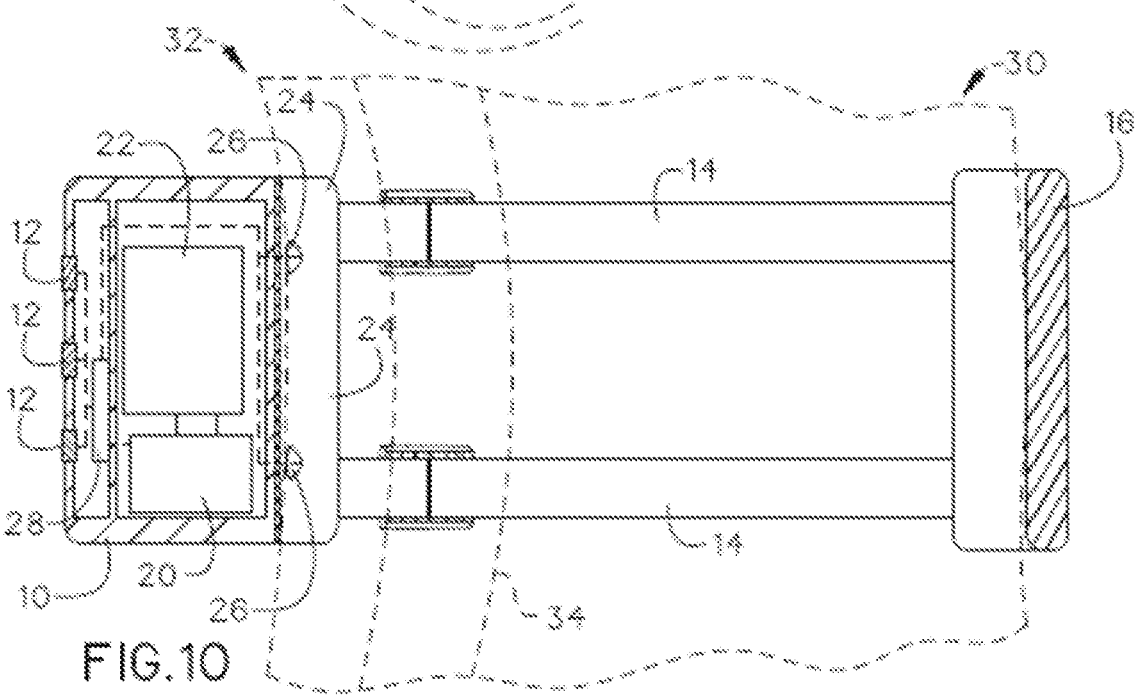
FIG. 10 is a section view of an exemplary embodiment of the present invention along line 10-10 in FIG. 1.
Figure 11:
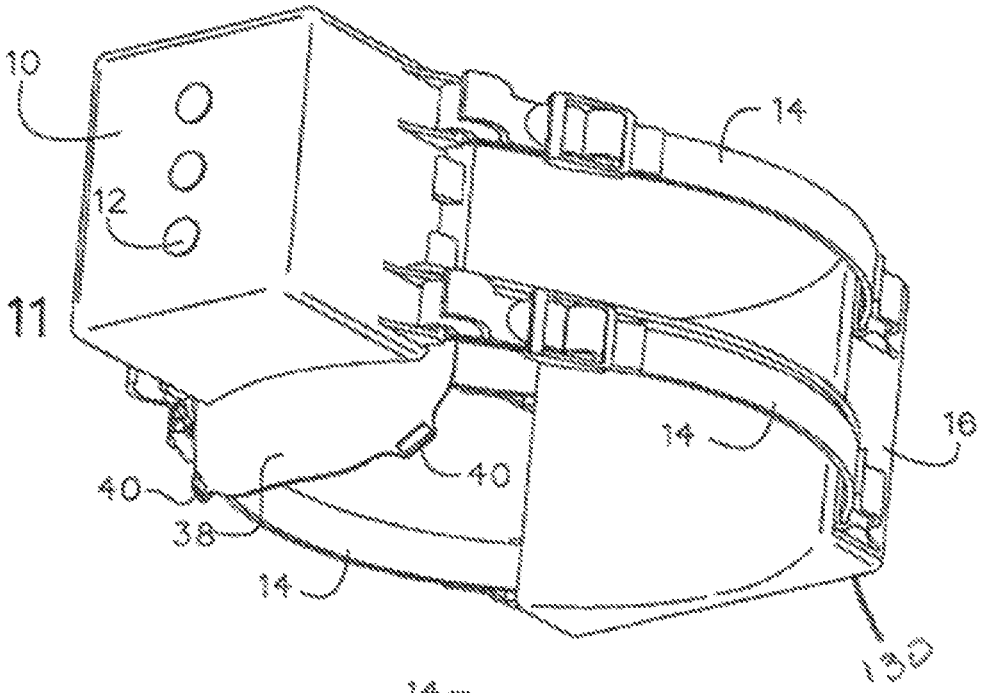
FIG. 11 is a bottom perspective view of an alternate embodiment of the present invention.
Figure 12:
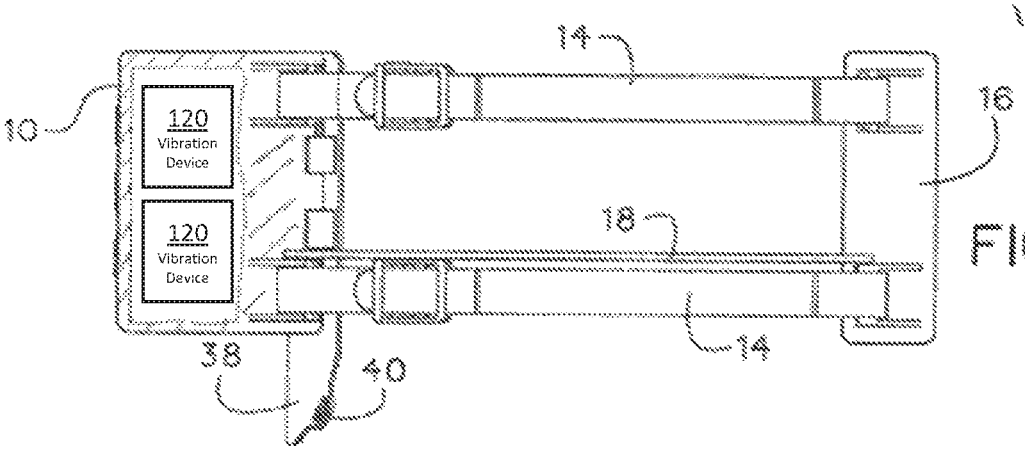
FIG. 12 is a side view of an alternate embodiment of the present invention.
Figure 13:
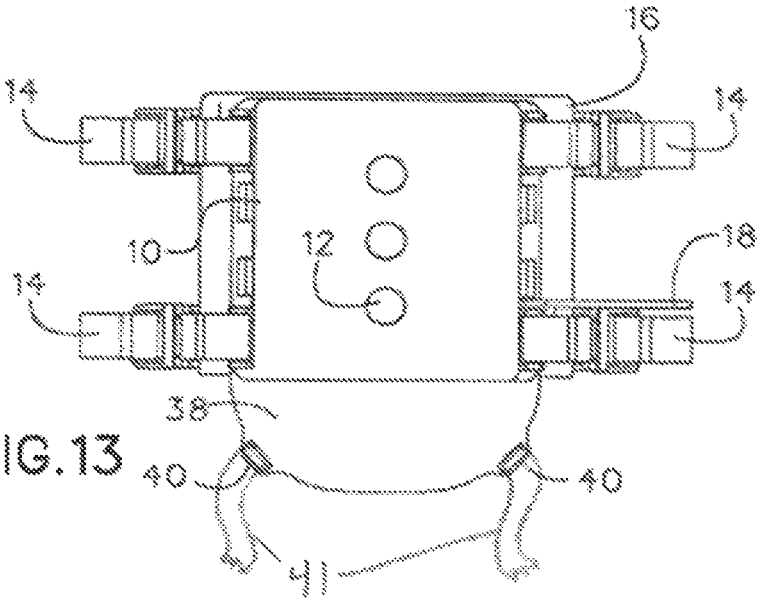
FIG. 13 is a front view of an alternate embodiment of the present invention.

As illustrated in FIGS. 1 through 13, a lung gas exchange device may include a front housing 10 housing a vibrating device and a control mechanism 12. The front housing 10 may include a front side, a rear side, and an interior housing. At least one wear plate 24 may attach to the front housing 10 and be adapted to transfer vibration to a patient's anterior neck 32, as shown in FIG. 10. By placing the wear plate 24 against a patient's anterior neck 32, the trachea 34 may be vibrated. The trachea 34 and lower airways are composed of cartilage and as such are semi-rigid. Thus, by vibrating the trachea 34, the vibrating device may vibrate the airways and the attached alveoli, thereby improving gas exchanged. Additionally, vibrating the trachea 34 vibrates the air column within the trachea 34, thus further improving gas exchange.

The wear plate 34 may be curved and optimally sized to focus vibration on the trachea 34. The wear plate 34 may be patient specific and formed to the contours and length of the patient's neck to maximize transfer of the vibration from the vibrating device to the patient's trachea 34. The wear plate 34 may be securely affixed to front housing 10 and the vibrating device. In some embodiments, the wear plate 34 may be removably affixed to the front housing 10 to allow for attachment of alternative wear plates. The one wear plate 24 may be made from a metal material. Alternatively, the wear plate 24 may be made of a non-rigid, semi-elastic material configured to maintain pressure from the wear plate 24 on the anterior neck of a user. In some embodiments, wear plate 24 may be made from a metal material but covered in a less rigid material to increase comfort for a patient.

The front housing 10 may include at least one control mechanism 12. In certain embodiments, the at least one control mechanism 12 may be one or more buttons. The at least one control mechanism 12 may also include one or more dials or other controls configured to allow for variable adjustments. The at least one control mechanism 12 may be connected to the front side of the front housing 10. The control mechanism 12 may include an on/off control to allow a patient to turn on or turn off the vibration device 120. The control mechanism 12 may also include controls to allow a user, such as a doctor, to optimally set various aspects of the vibration, such as the frequency and the amplitude. In certain embodiments, control mechanism 12 may also allow a user to control the direction or axis of vibration, or control whether the vibration is periodic, random, or follows a predetermined pattern. In some embodiments, control mechanism 12 may include a single control to allow a user, such as a patient, to turn on and off the vibration device 120 and include an interface 110, such as a wired or wireless interface, to allow a user, such as a doctor, to optimally tune the vibration device 120 for a patient.

Figure 1:
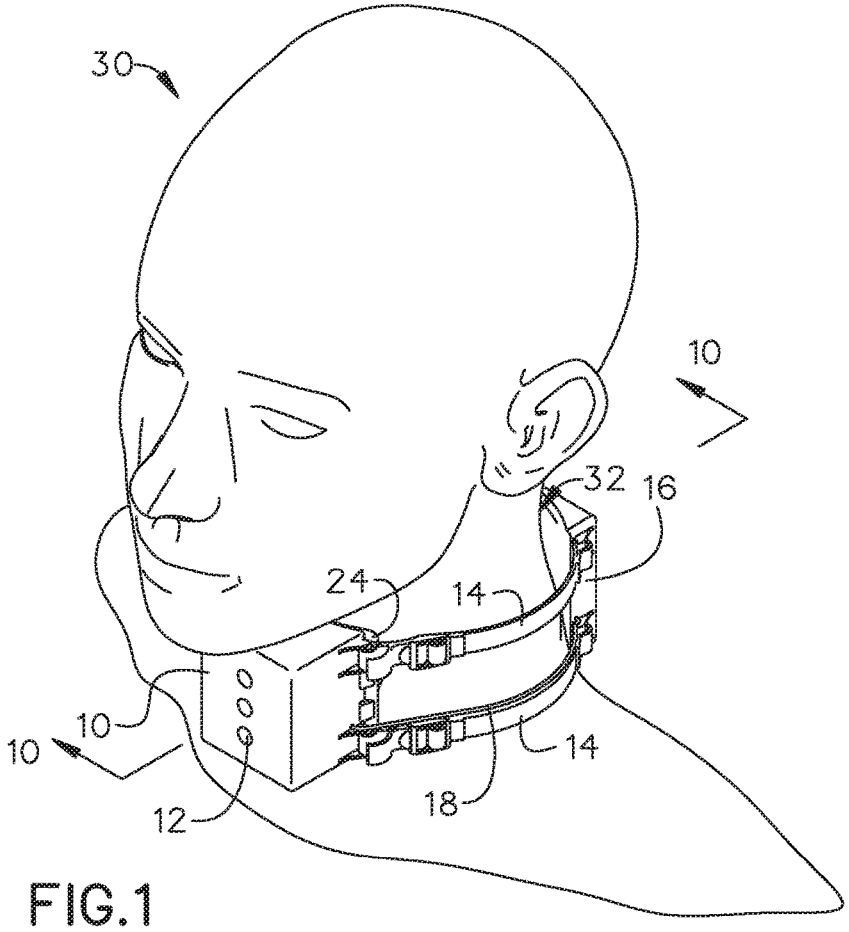
FIG. 1 is a perspective view of an exemplary embodiment of the present invention shown in use.
Figure 2:
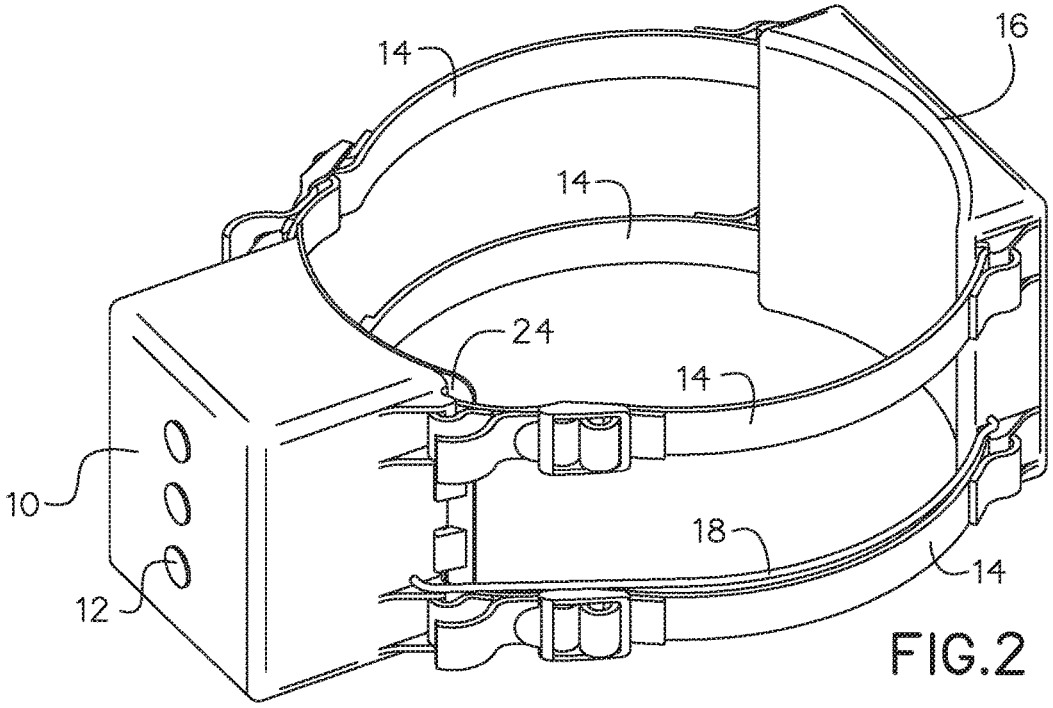
FIG. 2 is a perspective view of an exemplary embodiment of the present invention.
Figure 3:
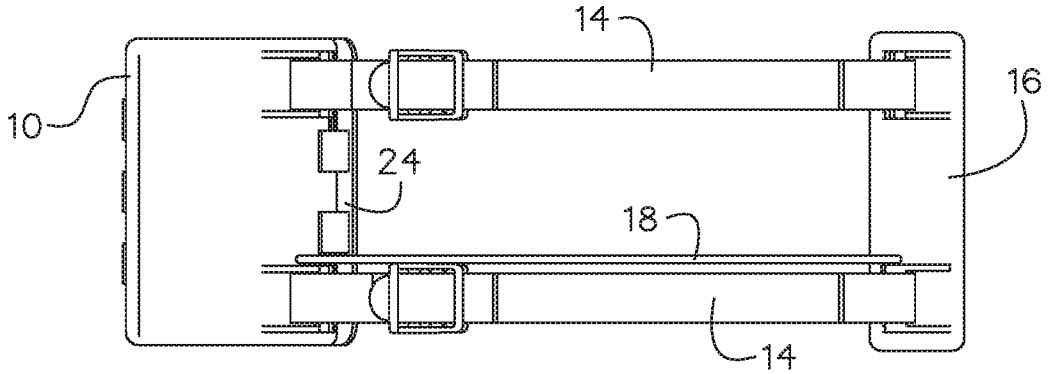
FIG. 3 is a side view of an exemplary embodiment of the present invention.
Figure 4:
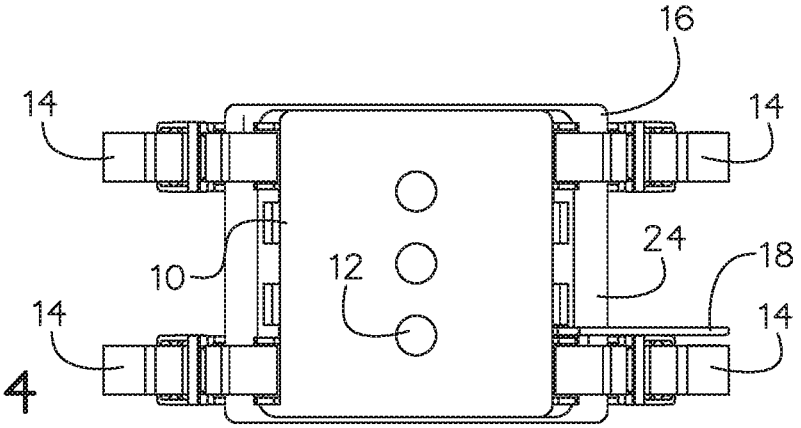
FIG. 4 is a front view of an exemplary embodiment of the present invention.
Figure 5:
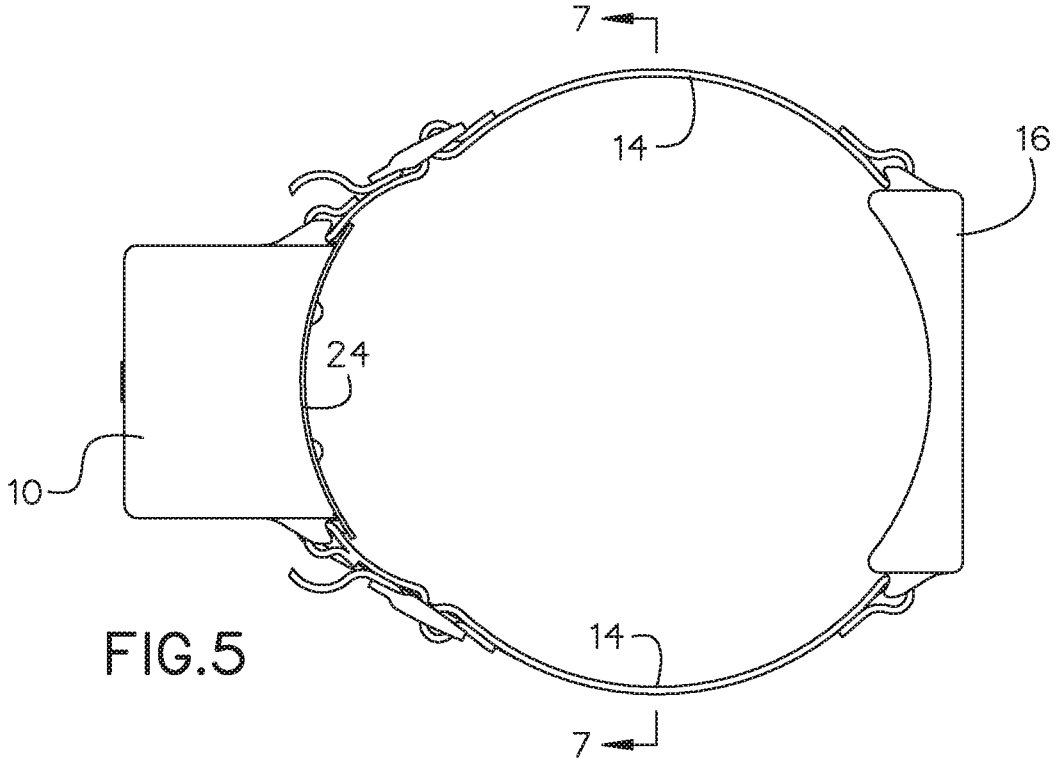
FIG. 5 is a top view of an exemplary embodiment of the present invention.
Figure 6:
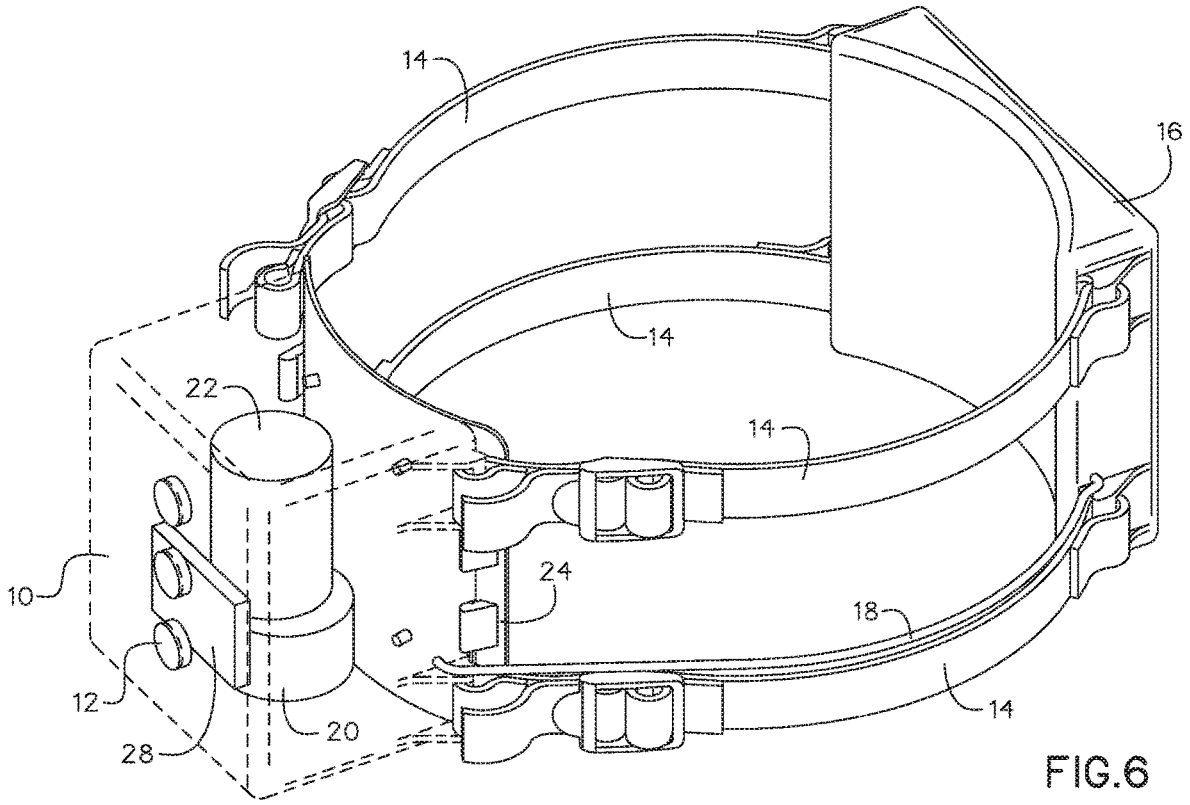
FIG. 6 is a perspective view of an exemplary embodiment of the present invention with a front cover shown in hidden-line for illustrative clarity of inner components.
Figure 7:
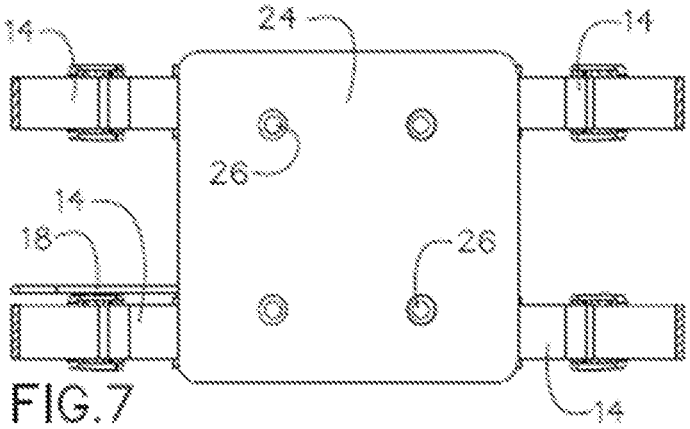
FIG. 7 is a section view of an exemplary embodiment of the present invention along line 7-7 in FIG. 5.
Figure 8:
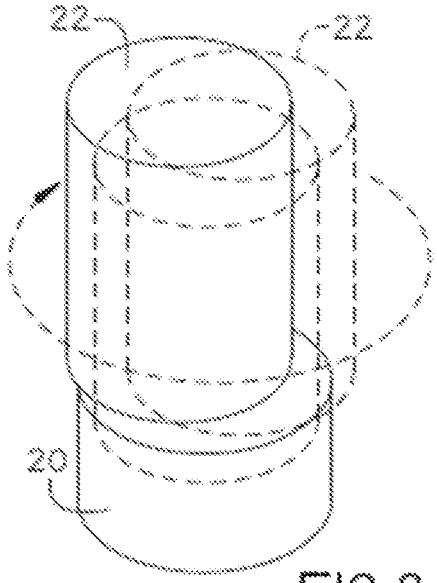
FIG. 8 is a perspective view of a motor and offset weight of an exemplary embodiment of the present invention.
Figure 9:
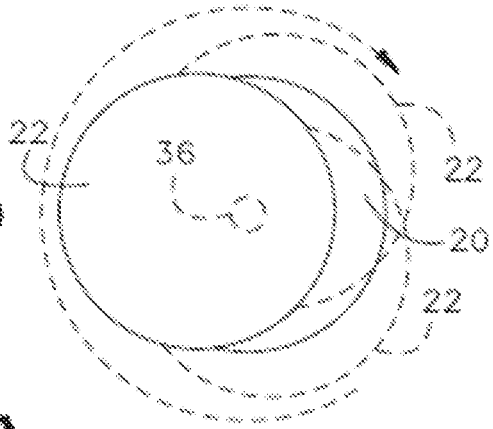
FIG. 9 is a top view of the motor and offset weight of an exemplary embodiment of the present invention.

As shown in FIG. 6, a motor 20 may be housed within the front housing 10. In certain embodiments, an offset weight 22 may be connected to the motor 20 within the interior of the front housing 10. A central processing unit board 28 may be housed within the interior of the front housing 10. At least one wear plate 24 may attach to the front cover 10. In certain embodiments, the wear plate 24 may attach to the rear side of the front cover 10.

At least one sensor 26 may attach to the wear plate 24. The gas exchange device may include one or more of a sensor for measuring a patient's oxygen saturation, carbon dioxide in the blood stream, heart rate, respiratory rate, and temperature. Embodiments may include a memory device 100 configured to store sensor measurements over time and an interface 150, such as a wireless interface, to allow a user, such as a patient or doctor, to access saved sensor measurements. In certain embodiments, the central processing board 28 may include a wireless interface and the gas exchange device may be configured to transmit sensor measurements to an external device, such as a smartphone or personal computer, with software configured to store the sensor data.

Embodiments may also include one or more sensors 26 configured to measure movement, such as sensors for measuring location based on GPS and/or a multi-direction accelerometer. Embodiments including sensors configured to measure movement may also capture data correlating a patient's health parameters, such as heart rate, oxygen saturation, carbon dioxide level, and respiratory rate with their movement.

In certain embodiments, the vibrator may be able to self-adjust to optimize the vibration parameters to enhance vibration and gas exchange dynamically. The central processing board 28 may include feedback controls that use data from the at least one sensor 26 to alter parameters of the vibration device to maintain optimal performance. In such embodiments, central processing board 28 may include a storage device with a vibration parameters map, such as a multi-variable vibration parameters map, to allow vibration parameters to be dynamically selected based on sensor feedback.

Embodiments may include a power source 16 positioned at the posterior or a user's neck. The power source 16 may be attached to the front housing 10 via one or more straps 14. The straps 14 may be configured such that the wear plate 24 exerts firm and consistent pressure on the anterior neck 32. A connecting cable 18 may connect the front housing 10 and the components within and along the front housing 10 to the power source 16. The at least one strap 14 may include a first end and a second end. The first end of the at least one strap 14 may connect to the front cover 10 and the second end of the at least one strap 14 may connect to the power source 16. The power source 16 may be at least one battery. The power source may rest on the back of the neck 32 and serve to counterbalance the vibrator as well as allow for more tracheal contact with the vibrator wear plate and greater power capacity. In alternative embodiments, the power source 16 may be integrated within front housing 10 and both ends of one or more straps 14 may connect to the front cover 10. The power source may also include a power wire, or an adaptor to which a power wire 140 can be connected, to allow for connection to an external power source to allow for longer run time. The external power source may be, for example, an outlet or an extended battery pack. The at least one strap 14 may be connected by fastener or the like.

The motor 20 may be of a variable speed variety. The motor 20 may act like a vibrator, providing a rotary axis 36 while an offset weight 22 may help to provide rotational momentum. Those of skill in the art understand that the vibration device may take alternative forms. For example, alternative embodiments may include linear, rather than rotational, actuation to provide an alternative direction of vibration. Embodiments may also include more than one vibration device, thereby allowing for additional control of the vibration parameters, including the frequency, amplitude, and direction of the vibration. Certain embodiments may include multiple vibration devices each mounted in an orientation selected to provide a desired direction of vibration.

In certain embodiments, additional vibrating wear plate(s) may be added to vibrate a portion of the chest bony wall, for example the sternal notch. By applying vibration directly to the bony chest wall, as opposed to the exterior of the chest where users typically have greater tissue mass, embodiments may further increase vibration of the alveoli to further improve gas transfer. An extended wear plate 38 may conform to the part of or the entire chest. In certain embodiments, at least one extended wear plate 38 may be used instead of the at least one wear plate 24. A strap loop 40 may be used with the at least one extended wear plate 38 to help secure the at least one extended wear plate 38 in the proper location. For example, straps 41 attached to strap loop 40 may extend under a user's armpits and around a user's back such that two ends of a strap attach to the strap loops 40 shown in FIG. 11. Embodiments including at least one extended wear plate 38 may have one or more additional vibration device that may be configured to transfer vibration to just the at least one extended wear plate 38. Embodiments may include one or more control mechanisms configured to control the extended wear plate 38 independently from the wear plate 24.

In certain embodiments, the posterior battery pack serves and may be constructed as to counterweight to the vibrator portion to maintain wear plate pressure against the anterior neck and chest. Additionally, there may be additional weight(s) and/or components added to the posterior compartment 130 if the battery weight is not sufficient.

It should be understood that the foregoing relates to exemplary embodiments of the invention and that modifications may be made without departing from the spirit and scope of the invention as set forth in the following claims.

What is claimed is:

1. A lung gas exchange device for treating a patient having a chronic respiratory disease, comprising:

a front housing;

at least one strap configured to affix the front housing to an anterior neck of a patient;

a vibration device positioned within the front housing;

a wear plate configured to be adapted to patient specific contours and length of a portion a trachea of the patient and further configured to vibrate a column of air by transferring vibration from the vibration device to the trachea;

a power source configured to provide power to the vibration device;

a central processing unit board connected to the power source and the vibration device; and at least one second strap having two ends attached to a strap loop of the wear plate, the at least one second strap is configured to extend under an armpit of the patient and around a back of the patient such that the two ends of the at least one second strap are attached to the strap loop.

2. The lung gas exchange device of claim 1, wherein the vibration device comprises:

a motor housed within the front housing; and an offset weight attached to the motor.

3. The lung gas exchange device of claim 1, further comprising:

at least one sensor attached to the wear plate and connected to the central processing unit board, wherein the at least one sensor is configured to capture data corresponding to a patient health, the lung gas exchange device further configured to self-adjust to optimize gas-exchange.

4. The lung gas exchange device of claim 3, wherein in response to signals received from the at least one sensor, the central processing unit board is configured to alter one or more parameters of the vibration device.

5. The lung gas exchange device of claim 4, further comprising a storage device, wherein the storage device stores a vibration parameters map, and wherein the central processing unit board is configured to dynamically select parameters for the vibration device from the vibration parameters map based on one or more measurement received from the at least one sensor.

6. The lung gas exchange device of claim 3, further comprising a memory device configured to store measurements from the at least one sensor.

7. The lung gas exchange device of claim 6, further comprising an interface configured to allow the patient to access saved sensor measurements.

8. The lung gas exchange device of claim 1, wherein the power source is connected to the at least one strap such that when the lung gas exchange device is affixed to the patient, the power source is disposed on a posterior neck of the patient.

9. The lung gas exchange device of claim 1, further comprising a control for altering an amplitude parameter of the vibration device.

10. The lung gas exchange device of claim 1, further comprising a control for altering a frequency parameter of the vibration device.

11. The lung gas exchange device of claim 1, wherein the wear plate is further configured to transfer vibration from the vibration device to a chest wall of the patient.

12. The lung gas exchange device of claim 11, wherein the at least one second strap is configured to secure an extended portion of the wear plate to the chest wall of the patient.

13. The lung gas exchange device of claim 1, wherein the wear plate is further configured to transfer vibration from the vibration device to a sternal notch of the patient.

14. The lung gas exchange device of claim 13, wherein the at least one second strap is configured to secure the wear plate to the sternal notch of the patient.

15. The lung gas exchange device of claim 13, further comprising a second vibration device positioned within the front housing.

16. The lung gas exchange device of claim 15, wherein the second vibration device positioned within the front housing is configured to provide vibration in a different direction from the vibration device.

17. The lung gas exchange device of claim 1, further comprising a posterior compartment configured to counterbalance the front housing.

18. The lung gas exchange device of claim 1, wherein the chronic respiratory disease is Chronic Obstructive Pulmonary Disease.

19. A method for treating a patient having chronic pulmonary disease, comprising:

vibrating a column of air by applying vibration to a portion of an anterior neck of the patient; and applying a lung gas exchange device to the portion of the anterior neck, wherein the lung gas exchange device comprises, a front housing;

at least one strap configured to affix the front housing to the portion of the anterior neck;

a vibration device positioned within the front housing;

a wear plate configured to vibrate a column of air by transferring vibration from the vibration device to the portion of the anterior neck;

a power source configured to provide power to the vibration device;

a central processing unit board connected to the power source and the vibration device; and at least one second strap having two ends attached to a strap loop of the wear plate, the at least one second strap is configured to extend under an armpit of the patient and around a back of the patient such that the two ends of the at least one second strap are attached to the strap loop, wherein the vibration of the column of air by applying the vibration to the portion of the anterior neck includes applying the vibration using the lung gas exchange device.

* * * * *